US008007967B2

(12) United States Patent
Yoo et al.

(10) Patent No.: US 8,007,967 B2
(45) Date of Patent: Aug. 30, 2011

(54) SHADOW MASK AND MANUFACTURING METHOD THEREOF

(75) Inventors: Soon Sung Yoo, Gyeonggi-do (KR); Oh Nam Kwon, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 416 days.

(21) Appl. No.: 11/475,110

(22) Filed: Jun. 27, 2006

(65) Prior Publication Data

US 2007/0001577 A1 Jan. 4, 2007

(30) Foreign Application Priority Data

Jun. 29, 2005 (KR) ..... 10-2005-0057317

(51) Int. Cl.
*H01J 29/07* (2006.01)

(52) U.S. Cl. ..... 430/23; 430/320; 430/5; 313/402

(58) Field of Classification Search ..... None
See application file for complete search history.

(56) References Cited

U.S. PATENT DOCUMENTS 5,164,021 A * 11/1992 Kato et al. ..... 148/621
2004/0067346 A1* 4/2004 Hofmann et al. ..... 428/195.1

FOREIGN PATENT DOCUMENTS

JP 62042523 * 2/1987
JP 09 157799 * 6/1997
JP 2002-212763 * 7/2002
JP 2003-229073 * 8/2003

OTHER PUBLICATIONS

Translation JP-2003-229073(Aug. 2003).*
Translation JP-2002-212763(Jul. 2002).*
Translation JP-09157799.*

* cited by examiner

*Primary Examiner* — Martin J Angebranndt
*Assistant Examiner* — Anna L Verderame
(74) *Attorney, Agent, or Firm* — Morgan, Lewis & Bockius LLP

(57) ABSTRACT

Disclosed is a shadow mask having a fine slit that can improve precision and resolution of a pattern by reducing side etching during an etching process of a mask substrate, and a manufacturing method thereof. The shadow mask includes a mask substrate, a slit region formed by penetrating through the mask substrate, the slit region having a plurality of undercut portions at respective sides thereof, each undercut portion having a unit thickness, and a shadow region provided in the mask substrate, the shadow region corresponding to a region other than the slit region.

18 Claims, 7 Drawing Sheets

SHADOW MASK AND MANUFACTURING METHOD THEREOF

The present invention claims the benefit of Korean Patent Application No. 10-2005-0057317 filed in Korea on Jun. 29, 2005, which is hereby incorporated by reference.

BACKGROUND OF THE INVENTION

1. Field of the Invention

The present invention relates to a shadow mask, and a manufacturing method thereof.

2. Discussion of the Related Art

FIGS. 1 to 3 are cross sectional views for sequentially illustrating a method of manufacturing a shadow mask according to the related art. The shadow mask is applied to a liquid crystal display apparatus (LCD apparatus) or an organic light-emitting diode (OLED) in order to form printed patterns. According to the shadow mask manufacturing method in the related art, a photoresist pattern PR is formed on a mask substrate 10 as shown in FIG. 1. The mask substrate 10 is then wet etched using the photoresist pattern PR as an etching mask as shown in FIG. 2. The photoresist pattern PR on the mask substrate 10 is finally removed as shown in FIG. 3, thereby completing the manufacturing process of the shadow mask. FIG. 4 is a plan view illustrating a part of a shadow mask according to the related art. FIG. 5 is a cross sectional view illustrating the shadow mask shown in FIG. 4, the cross sectional view taken along the line I-I'. As shown in FIG. 4 and FIG. 5, the related art shadow mask is characterized by thickness R1, size of the shadow region R2, size of the slit region R3 in which slits corresponding to final printed patterns are formed, length R4 of the upper part of the mask, and the pitch R5. Generally, the thickness R1 of a shadow mask is 40 micrometers to 50 micrometers. The size of the shadow region R2 is 100 micrometers or 120 micrometers. The size of slit region R3 is 40 micrometers, and the length R4 of upper part of the mask is about 20 micrometers.

When manufacturing the shadow mask according to the above described method, a large amount of side etching occurs beneath the photoresist pattern PR. Therefore, it is difficult to manufacture a shadow mask having slits or slots with precise sizes. Further, it is difficult to manufacture a shadow mask having slits or slots with substantially uniform sizes along the vertical direction of the mask. Generally the size of the side etching is about 40 micrometers or more when the thickness of the mask is 40 micrometers. Since it is impossible to have the pitch R5 be smaller than the sum of half the thickness of the mask (0.5*R1) and the length of the slit region R3, the pitch R5 must be 140 micrometers or more if the length of the slit region R3 is 40 micrometers. In this case, if the side etching occurs by 2 micrometers at respective sides of the slit region, the length of the slit region R3 must be 44 micrometers or more. Further, since there can be severe process errors in the shadow mask manufacturing method according to the related art, it is difficult to design a shadow mask with fine pitches or patterns using the conventional manufacturing technologies.

SUMMARY OF THE INVENTION

Accordingly, the present invention is directed to a shadow mask and manufacturing method thereof that substantially obviates one or more of the problems due to limitations and disadvantages of the related art.

An object of the present invention is to provide a shadow mask having fine slits, thereby having an advantage of improving precision and resolution of patterns by reducing the amount of side etching when etching a mask substrate.

Another object of the present invention is to provide a manufacturing method of a shadow mask capable of effectively producing a shadow mask having the above described advantage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask and manufacturing method thereof includes a shadow mask comprising a mask substrate, a slit region formed by penetrating through the mask substrate, the slit region having a plurality of undercut portions at respective sides thereof, each undercut portion having a unit thickness, and a shadow region provided in the mask substrate, the shadow region corresponding to a region other than the slit region.

In another aspect of the present invention, a method of manufacturing a shadow mask includes forming a predetermined metal pattern on a mask substrate, etching a portion of the mask substrate using the metal pattern as an etching mask, filling undercut portions of the mask substrate with photoresist, caused during the etching, etching a portion of the mask substrate using the metal pattern as an etching mask, repeating the steps of filling undercut portions of the mask substrate with photoresist, caused during the etching and etching a portion of the mask substrate using the metal pattern as an etching mask by a predetermined number of times until a slit region is completely formed in the mask substrate.

In another aspect of the present invention, a method of manufacturing a shadow mask further includes removing the metal pattern through an etching method by etching.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Reference will now be made in detail to the preferred embodiments of the present invention, examples of which are illustrated in the accompanying drawings.

Figure 1:
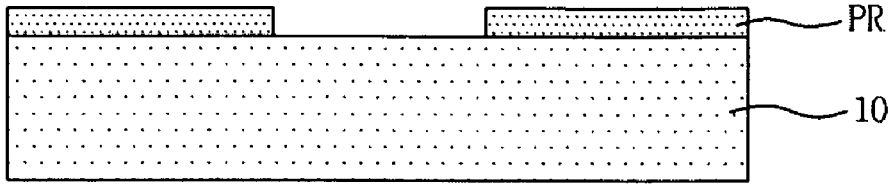
Fig. 1 (Related Art)
FIGS. 1 through 3 are cross sectional views sequentially illustrating a method of manufacturing a shadow mask according to the related art.
Figure 2:
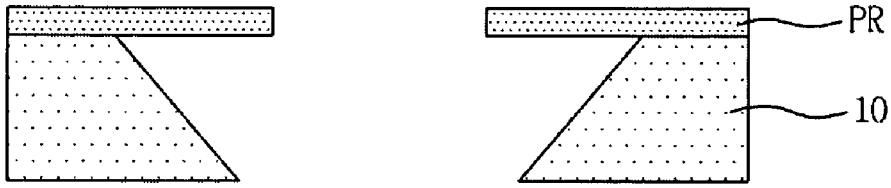
Fig. 2 (Related Art)
Figure 3:
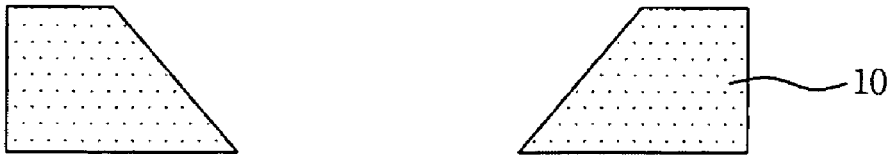
Fig. 3 (Related Art)
Figure 4:
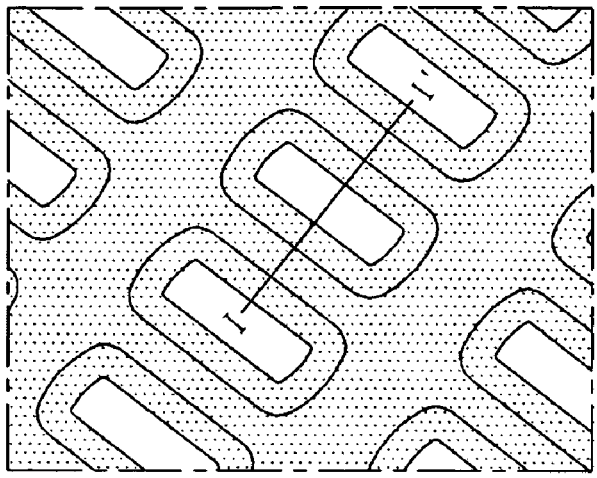
Fig. 4 (Related Art)
FIG. 4 is a plan view illustrating a part of a shadow mask according to the related art.
Figure 5:
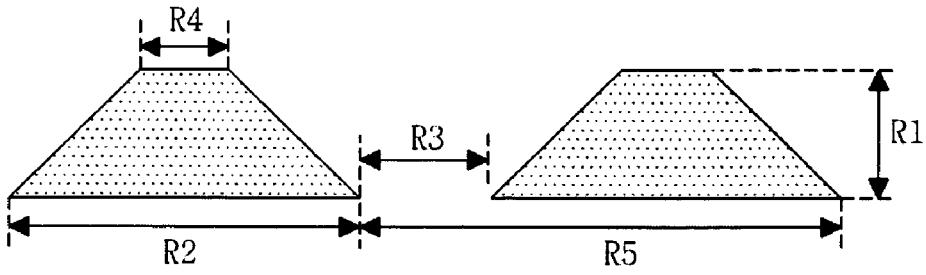
Fig. 5 (Related Art)
FIG. 5 is a cross sectional view taken along the line I-I' in FIG. 4.
Figure 6:
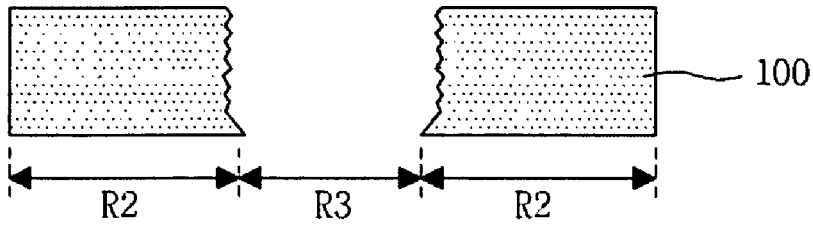
FIG. 6 is a cross sectional view illustrating a part of a shadow mask according to one embodiment of the present invention.

FIG. 6 is a cross sectional view illustrating a part of the shadow mask according to one embodiment of the present invention. The shadow mask according to the embodiment shown in FIG. 6 of the present invention comprises a mask substrate 100 made of iron (Fe) or iron-nickel alloy (Fe—Ni alloy). The mask substrate 100 comprises a slit region R3 and a shadow region R2. The slit region R3 has one or more slits, each formed through the mask substrate 100. The shadow region R2 is a region other than the slit region R3. During the manufacturing process of the shadow mask, the slit region R3 in the mask substrate 100 undergoes an etching process, while the shadow region R2 in the mask substrate 100 does not undergo an etching process. Each of respective sides of the slit region R3 has a plurality of undercut portions, each having a unit thickness. The mask substrate 100 has a thickness of 30 to 300 micrometers, and the unit thickness of each undercut portion is about 2 to 15 micrometers.

Figure 7:
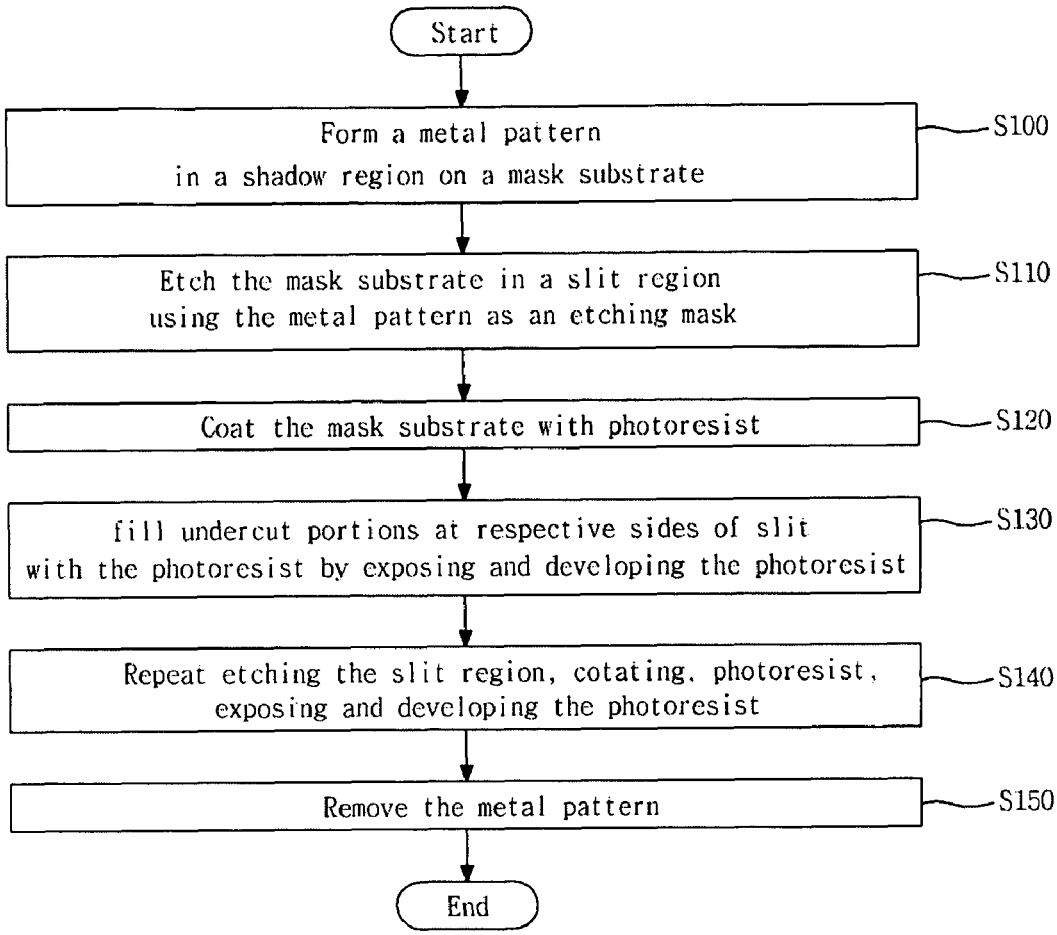
FIG. 7 is a flow chart showing a manufacturing method of a shadow mask according to one embodiment of the present invention.

FIG. 7 is a flow chart showing the overall manufacturing method of the shadow mask. Each step in FIG. 7 is specifically demonstrated in FIG. 8 through FIG. 18, which illustrate respective steps of the manufacturing method.

Figure 8:
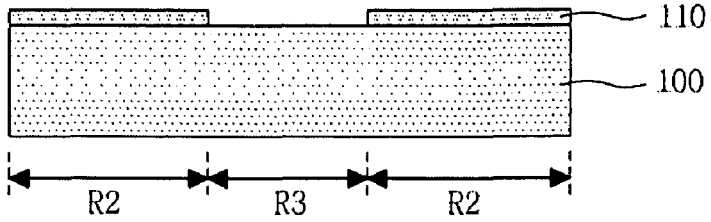
FIG. 8 through FIG. 14 are cross sectional views sequentially illustrating the manufacturing method of a shadow mask, shown in FIG. 8.

During step S100, a metal pattern 110 is formed on a mask substrate 100 comprising a shadow region R2 and a slit region R3, in which the metal pattern 110 is formed only in the shadow region R2. The metal pattern 110 and the mask substrate 100 showing the regions are shown in FIG. 8. The mask substrate 100 may be made of iron (Fe) or iron-nickel alloy (Fe—Ni alloy). The mask substrate 100 is about 30 to 300 micrometers thick. The step S100 comprises a plurality of sub-steps. As an example, the sub-steps may comprise the following four steps. First, a metal such as chrome (Cr) is deposited on the entire surface of the mask substrate 100 to form a metal layer with thickness of about 1000 angstroms. Second, the surface of the metal layer is coated with a photoresist. Third, the photoresist is exposed and developed to form a photoresist pattern corresponding to a metal pattern 110 to be formed through subsequent processes. Finally, the metal layer is etched using the photoresist pattern as an etching mask, thereby forming the metal pattern 110.

Figure 9:
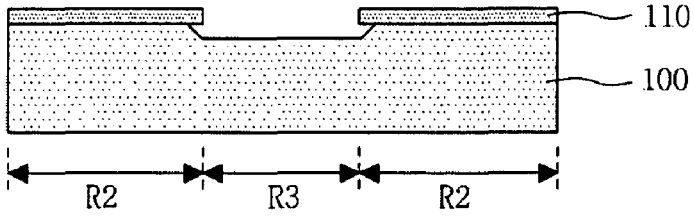

During S110, as shown in FIG. 9, the slit region R3 of the mask substrate 100 is etched through a wet etching method using the metal pattern 110 as an etching mask. The etching process is controlled such that the thickness of the undercut occurring at respective sides of the slit region R3 is fixed to a predetermined unit thickness. As a result, the width of the undercut caused by side etching can be minimized. The thickness of the undercut portion is about 2 to 15 micrometers, and the undercut portion is formed through an isotropic etching process.

Figure 10:
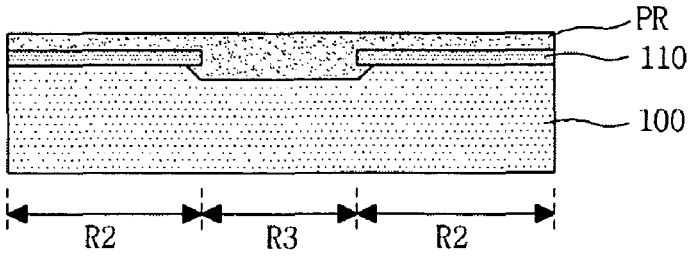

During S120, as shown in FIG. 10, the surface of the mask substrate 100 is coated with a photoresist PR.

Figure 11:
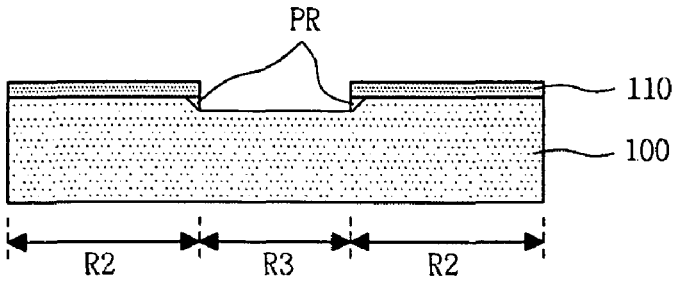

During S130, as shown in FIG. 11, the photoresist on the mask substrate 100 is exposed and developed to fill the undercut portions at respective sides of the slit region R3 with the photoresist.

Figure 12:
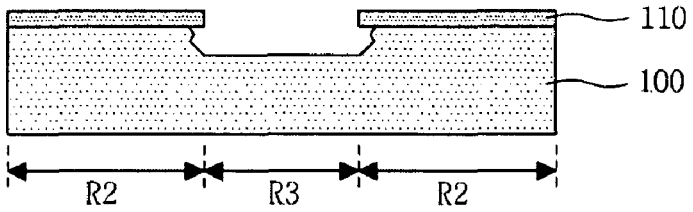
Figure 13:
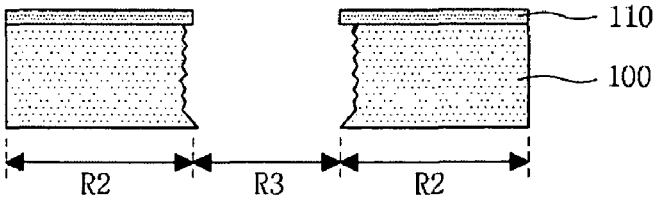

During S140, as shown in FIG. 12 and FIG. 13, the slit region R3 of the mask substrate 100 is etched to a predetermined unit thickness. Then, the surface of the mask substrate 100 is coated again with the photoresist PR. The photoresist PR is exposed and developed to fill the undercut portions formed at respective sides of the slit region R3 with the photoresist PR. The steps of etching the slit region R3 of the mask substrate 100 and filling the undercut portions are repeated by a predetermined number of times until the slit penetrating through the mask substrate 100 is formed in the slit region R3. The predetermined number of times is determined according to the desired precision of the metal pattern 110.

Figure 14:
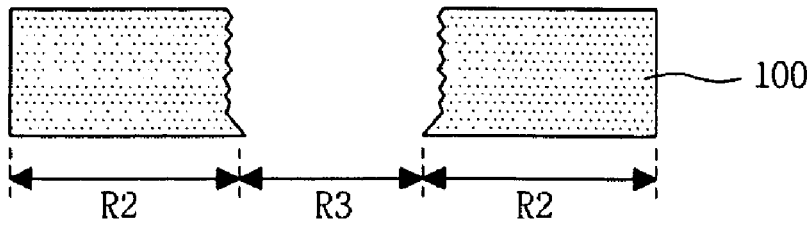

During S150, as shown in FIG. 14, the metal pattern 110 is removed through an etching process. This step completes the manufacturing process of the shadow mask having a plurality of undercut portions at respective sides of each slit in the slit region R3.

In conclusion, the manufacturing method according to the present invention comprises the steps of forming a metal layer made of chrome (Cr) on a mask substrate 100 which is made of a metal such as iron (Fe) or iron-nickel (Fe—Ni) alloy. The manufacturing method further comprises partially etching the metal layer to form a metal pattern 110, etching the mask substrate 100 using the metal pattern 110 as an etching mask, repeating the etching of the mask substrate 110 and filling the undercut portions with photoresist by coating, exposing and developing photoresist. Since the etching processes are repeated such that the undercut portions at respective sides of the slit in the slit region R3 are filled with photoresist PR, side etching can be reduced. Thus, as the unit thickness becomes smaller, the number of repetitions of the above described processes gets larger, and therefore the sidewalls of the slit in the slit region R3 becomes smoother, i.e. closer to the substantially vertical profile.

As described above, the shadow mask according to the embodiment of the present invention can implement fine slits that can improve precision and resolution of a pattern by reducing an amount of side etching when etching a mask substrate. Also, the manufacturing method of a shadow mask according to the embodiment of the present invention has an advantage of effectively manufacturing a shadow mask.

It will be apparent to those skilled in the art that various modifications and variations can be made in the apparatus for manufacturing flat panel display and the method of manufacturing the same of the present invention without departing from the spirit or scope of the invention. Thus, it is intended that the present invention covers the modifications and variations of this invention provided they come within the scope of the appended claims and their equivalents.

What is claimed is:

1. A shadow mask, comprising:

a mask substrate;

a slit region formed by a first etching through the mask substrate using an etching mask, the slit region including etched side walls having a plurality of undercut portions, each undercut portion having a predetermined unit thickness so that the undercut portions have substantially the same thickness with each other; and a shadow region provided in the mask substrate, the shadow region corresponding to a region other than the slit region, wherein the slit region is further etched by a second etching performed after only regions under the etching mask are filled with photoresist, and wherein the predetermined unit thickness of each of the undercut portions is about 2 to 15 micrometers.

2. The shadow mask according to claim 1, wherein the mask substrate is made of iron or iron-nickel alloy.

3. The shadow mask according to claim 1, wherein the mask substrate is about 30 to 300 micrometers thick.

4. A method of manufacturing a shadow mask, comprising:

forming a predetermined metal pattern on a mask substrate;

partially etching the mask substrate by a predetermined unit thickness using the predetermined metal pattern as an etching mask;

filling undercut portions formed during the step of partially etching the mask substrate with photoresist;

partially etching the partially etched portion of the mask substrate using the predetermined metal pattern as an etching mask after only regions under the etching mask are filled with the photoresist; and repeating the steps of filling undercut portions formed during the step of partially etching the mask substrate with photoresist and partially etching the partially etched portion of the mask substrate using the predetermined metal pattern as an etching mask by a predetermined number of times until a slit region is completely formed so that the undercut portions have substantially the same thickness with each other, wherein the predetermined unit thickness of the undercut portion is 2 to 15 micrometers.

5. The method according to claim 4, further comprising removing the predetermined metal pattern by etching.

6. The method according to claim 4, wherein the step of forming a predetermined metal pattern comprises:

depositing a metal material on the entire surface of the mask substrate;

coating the surface of the metal material with photoresist;

exposing and developing the photoresist, thereby forming a photoresist pattern corresponding to the metal pattern on the metal material; and etching the metal material using the photoresist pattern as an etching mask, thereby forming the metal pattern.

7. The method according to claim 4, wherein the slit region is made through a wet etching process.

8. The method according to claim 4, wherein the predetermined number of times is determined according to desired precision of the metal pattern.

9. The method according to claim 4, wherein the mask substrate is made of iron or iron-nickel alloy.

10. The method according to claim 4, wherein the metal pattern is made of chrome.

11. The method according to claim 4, wherein the mask substrate is about 30 to 300 micrometers in thickness.

12. The method according to claim 4, wherein the undercut portion is formed because the mask substrate is etched isotropically in vertical direction and lateral direction.

13. A method of manufacturing a shadow mask, comprising:

forming a metal pattern in a shadow region on a metal mask including the shadow region and a slit region;

etching the metal mask in the slit region by a predetermined unit thickness using the metal pattern as an etching mask so that undercut portion are defined in the metal mask under edge portions of the metal pattern;

coating the entire surface of the metal mask with the metal pattern thereon with photoresist such that photoresist is deposited in the undercut portions;

exposing the photoresist such that the photoresist in the undercut portions is shielded by the metal pattern;

developing the photoresist on the metal mask, thereby maintaining the photoresist in the undercut portions;

forming a slit penetrating through the metal mask in the slit region by repeating the steps of etching the metal mask in the slit region by the predetermined unit thickness, coating the surface of the metal mask with photoresist, and filling undercut portions at respective sides of the slit region with the photoresist by a predetermined number of times so that the undercut portions have substantially the same thickness with each other; and removing the metal pattern by etching, wherein the size of the undercut portion is about 2 to 15 micrometers.

14. The method according to claim 13, wherein the step of forming the metal pattern comprises:

depositing a metal material on the entire surface of the metal mask;

coating the surface of the metal material with photoresist;

exposing and developing the photoresist, thereby forming a photoresist pattern corresponding to the metal pattern on the metal material;

etching the metal material using the photoresist pattern as an etching mask, thereby forming the metal pattern.

15. The method according to claim 13, wherein the slit region is formed through a wet etching process.

16. The method according to claim 13, wherein the predetermined number of times is determined according to desired precision of the metal pattern.

17. The method according to claim 13, wherein the metal mask is made of iron or iron-nickel alloy, and the metal pattern is made of chrome.

18. The method according to claim 13, wherein the metal mask is about 30 to 300 micrometers in thickness, and the undercut portion is made by isotropically etching the metal mask in vertical direction and in lateral direction.

* * * * *